US010404026B2

(12) United States Patent
Idota et al.

(10) Patent No.: US 10,404,026 B2
(45) Date of Patent: Sep. 3, 2019

(54) METHOD FOR MANUFACTURING TERMINAL-EQUIPPED ELECTRICAL WIRE AND TERMINAL-EQUIPPED ELECTRICAL WIRE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tomoki Idota, Mie (JP); Ryouya Okamoto, Mie (JP); Hiroshi Shimizu, Mie (JP); Hitoshi Takeda, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/083,349

(22) PCT Filed: Feb. 24, 2017

(86) PCT No.: PCT/JP2017/006996
§ 371 (c)(1),
(2) Date: Sep. 7, 2018

(87) PCT Pub. No.: WO2017/154613
PCT Pub. Date: Sep. 14, 2017

(65) Prior Publication Data

US 2019/0131753 A1 May 2, 2019

(30) Foreign Application Priority Data

Mar. 10, 2016 (JP) ..... 2016-046672

(51) Int. Cl.
*H01R 43/02* (2006.01)
*H01R 4/02* (2006.01)

(52) U.S. Cl.
CPC ..... *H01R 43/0263* (2013.01); *H01R 4/029* (2013.01); *H01R 43/0207* (2013.01)

(58) Field of Classification Search
CPC . H01R 43/0263; H01R 43/0207; H01R 4/029
(Continued)

(56) References Cited

U.S. PATENT DOCUMENTS

2002/0130159 A1* 9/2002 Kondo ..... B23K 20/10 228/110.1
2004/0020580 A1* 2/2004 Oishi ..... B23K 20/106 156/73.1
(Continued)

FOREIGN PATENT DOCUMENTS

JP 09-082374 3/1997
JP 2001-068173 3/2001
(Continued)

OTHER PUBLICATIONS

Official Communication issued in International Bureau of WIPO Patent Application No. PCT/JP2017/006996, dated May 23, 2017.

*Primary Examiner* — Sherman Ng
(74) *Attorney, Agent, or Firm* — Greenblum & Bernstein, P.L.C.

(57) ABSTRACT

In a method for manufacturing a terminal-equipped electrical wire a core wire of an electrical wire is connected to a flat plate-shaped electrical wire connector portion of a terminal. An ultrasonic welding jig including an anvil and a welding horn is provided. After the electrical wire connector portion is placed on the anvil, the core wire of the electrical wire is placed on the electrical wire connector portion. By applying ultrasonic vibration along the axial direction of the core wire while pressing the core wire using the welding
(Continued)

horn, the core wire is ultrasonically welded to the electrical wire connector portion. On the upper surface of the wire connection portions of the terminal, a positioning groove, into which the core wire is fit, is formed in advance, and the core wire is placed on the electrical wire connector portion while being fit into the positioning groove.

3 Claims, 16 Drawing Sheets

(58) Field of Classification Search
USPC ..... 174/133 B
See application file for complete search history.

(56) References Cited

U.S. PATENT DOCUMENTS

| | | | | |
|---|---|---|---|---|
| 2006/0208033 | A1* | 9/2006 | Welter | B23K 11/002 228/110.1 |
| 2011/0062218 | A1* | 3/2011 | Ohnuma | B23K 20/106 228/110.1 |
| 2014/0014709 | A1* | 1/2014 | Takayashiki | H01R 4/023 228/110.1 |

FOREIGN PATENT DOCUMENTS

| | | |
|---|---|---|
| JP | 2013-004406 | 1/2013 |
| JP | 2014-143177 | 8/2014 |
| JP | 2015-153604 | 8/2015 |

* cited by examiner

METHOD FOR MANUFACTURING TERMINAL-EQUIPPED ELECTRICAL WIRE AND TERMINAL-EQUIPPED ELECTRICAL WIRE

TECHNICAL FIELD

The present invention relates to a method for manufacturing a terminal-equipped electrical wire, and a terminal-equipped electrical wire.

BACKGROUND ART

It is known that a terminal of a core wire in an electrical wire is connected to a bus bar through ultrasonic welding. Specifically, an ultrasonic welding jig including an anvil and a welding horn is provided, and after a bus bar is placed on the anvil, the core wire of the electrical wire is placed on the bus bar. By applying ultrasonic vibration along the axial direction of the core wire while pressing the core wire using the welding horn, the core wire is ultrasonically welded to the bus bar (see Patent Document 1 below).

CITATION LIST

Patent Documents

Patent Document 1: JP 2013-4406A

SUMMARY OF INVENTION

Technical Problem

With the above-described prior technique, it is difficult to place the core wire of the electrical wire at a certain position on the bus bar before the welding step, and if there is positional misalignment, there is a risk of incurring a situation in which the core wire cannot be properly pressed by the welding horn, thus incurring a welding defect. In order to avoid such a situation, it is conceivable to provide a separate positioning member and place the core wire at the certain position, but this is problematic not only in that the equipment of the jig is complicated, but also in that the number of steps in the welding task increases.

The technique disclosed in the present specification has been completed based on the above-described circumstance, and it is an object thereof to enable suitable ultrasonic welding while suppressing complication of the equipment and steps.

Solution to the Problem

A method for manufacturing a terminal-equipped electrical wire disclosed in the present specification is a method for manufacturing a terminal-equipped electrical wire including a core wire, the core wire of the electrical wire being connected to a flat plate-shaped electrical wire connection portion provided on a terminal, wherein an ultrasonic welding jig including an anvil and a welding horn is provided, the core wire of the electrical wire is placed on the electrical wire connection portion after the electrical connection portion of the terminal is placed on the anvil, and the core wire is ultrasonically welded to the electrical wire connection portion by applying ultrasonic vibration along an axial direction of the core wire while pressing the core wire with the welding horn, a positioning groove into which the core wire of the electrical wire is to be fit being formed in advance on an upper surface of the electrical wire connection portion of the terminal, and the core wire being placed on the electrical wire connection portion while being fit into the positioning groove.

When the core wire of the electrical wire is to be placed on the electrical wire connection portion of the terminal received by the anvil, the core wire can be placed easily and reliably at the proper position of the electrical wire connection portion by merely fitting the core wire into the positioning groove. For this reason, it is possible to properly press and ultrasonically vibrate the core wire using the welding horn, and ultrasonic welding can be performed suitably.

Also, the positioning groove may be formed with a bottom wall of the positioning groove pushed out toward the lower surface side of the electrical wire connection portion, a recessed groove into which the bottom wall of the positioning groove is to fit may be formed on an upper surface of the anvil, and the electrical wire connection portion is placed on the anvil while the bottom wall of the positioning groove is fit into the recessed groove.

The wire connection portion of the terminal can be easily and reliably placed at the proper position on the anvil.

A terminal-equipped electrical wire disclosed in the present specification is a terminal-equipped electrical wire including a core wire, the core wire of the electrical wire being ultrasonically welded to a flat plate-shaped electrical wire connection portion provided on a terminal, wherein a positioning groove is formed on an upper surface of the electrical wire connection portion and a welded portion of the core wire is adhered while fit into the positioning groove.

By viewing the structure of the adhering portion of the welded portion, it is possible to check whether or not the core wire has been suitably ultrasonically welded.

Also, a bottom wall of the positioning groove may be formed bulging toward a lower surface side of the electrical wire connection portion.

This configuration is applied in the case where the electrical connection portion of the terminal is comparatively thin. The pushed-out bottom wall can be used for positioning when being placed on the anvil.

Furthermore, the positioning groove may be formed with an upper surface of the electrical wire connection portion recessed.

This configuration can be applied in the case where the electrical connection portion of the terminal is comparatively thick.

Advantageous Effects of the Invention

With the technique disclosed in the present embodiment, ultrasonic welding can be performed correctly while suppressing complication of the equipment and steps.

DESCRIPTION OF EMBODIMENTS

Embodiment 1

Embodiment 1 will be described with reference to FIGS. 1 to 12. As shown in FIG. 10, a terminal-equipped electrical wire 10 according to the present embodiment has a structure in which a bus bar 20 (corresponds to a terminal) is connected by ultrasonic welding to the terminal end of a coated electrical wire 11 (corresponds to an electrical wire), and for example, is applied to a wiring portion such as a battery module mounted in an electric automobile.

Figure 1:
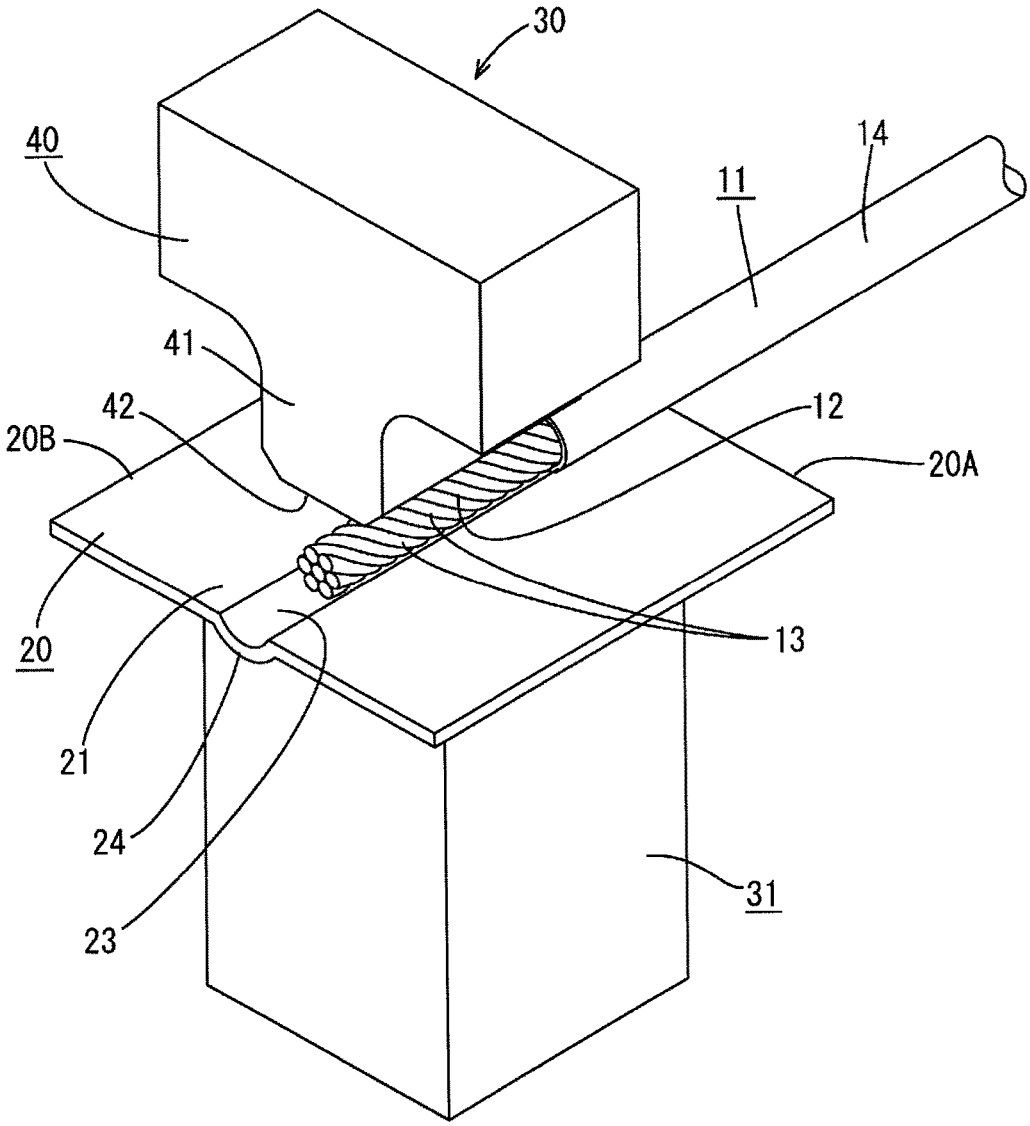
FIG. 1 is a perspective view of a state before ultrasonic welding according to Embodiment 1 is performed.

As shown in FIG. 1, the coated electrical wire 11 is a structure in which the outer circumference of the core wire 12 constituted by a twisted wire obtained by twisting together seven strands 13 made of metal, which are shown in the drawing, is covered by an insulating coating 14 made of synthetic resin. Terminal end processing in which the core wire 12 is exposed due to the insulating coating 14 being stripped off by a predetermined length is carried out on the terminal end of the coated electrical wire 11.

The bus bar 20 is made of metal that is relatively thin, and as shown in FIG. 1, is formed into a flat plate shape having a square shape in plan view, which has a side length that is larger than the length of the exposed core wire 12 of the above-described coated electrical wire 11.

An electrical wire connection portion 21 is set in the central portion in the direction along the horizontal side 20A of the bus bar 20 (left-right direction of FIG. 2), and as will be described later, the terminal end of the core wire 12 in the coated electrical wire 11 is placed on the electrical wire connection portion 21 in an orientation along the vertical side 20B of the bus bar 20 and is adhered through ultrasonic welding.

Here, on the electrical wire connection portion 21 of the bus bar 20, a positioning groove 23 into which the terminal end portion of the coated electrical wire 11 including the entire length of the exposed core wire 12 is formed over the entire length in the vertical direction of the electrical wire connection portion 21. Specifically, as shown in FIG. 2, the positioning groove 23 has a circular arc-shaped cross section with a diameter that is the same as the diameter of the coated electrical wire 11, and due to the bottom wall 24 being pushed out toward the lower surface side of the electrical wire connection portion 21, the positioning groove 23 is formed bulging toward the lower surface side of the electrical connection portion 21.

Figure 2:
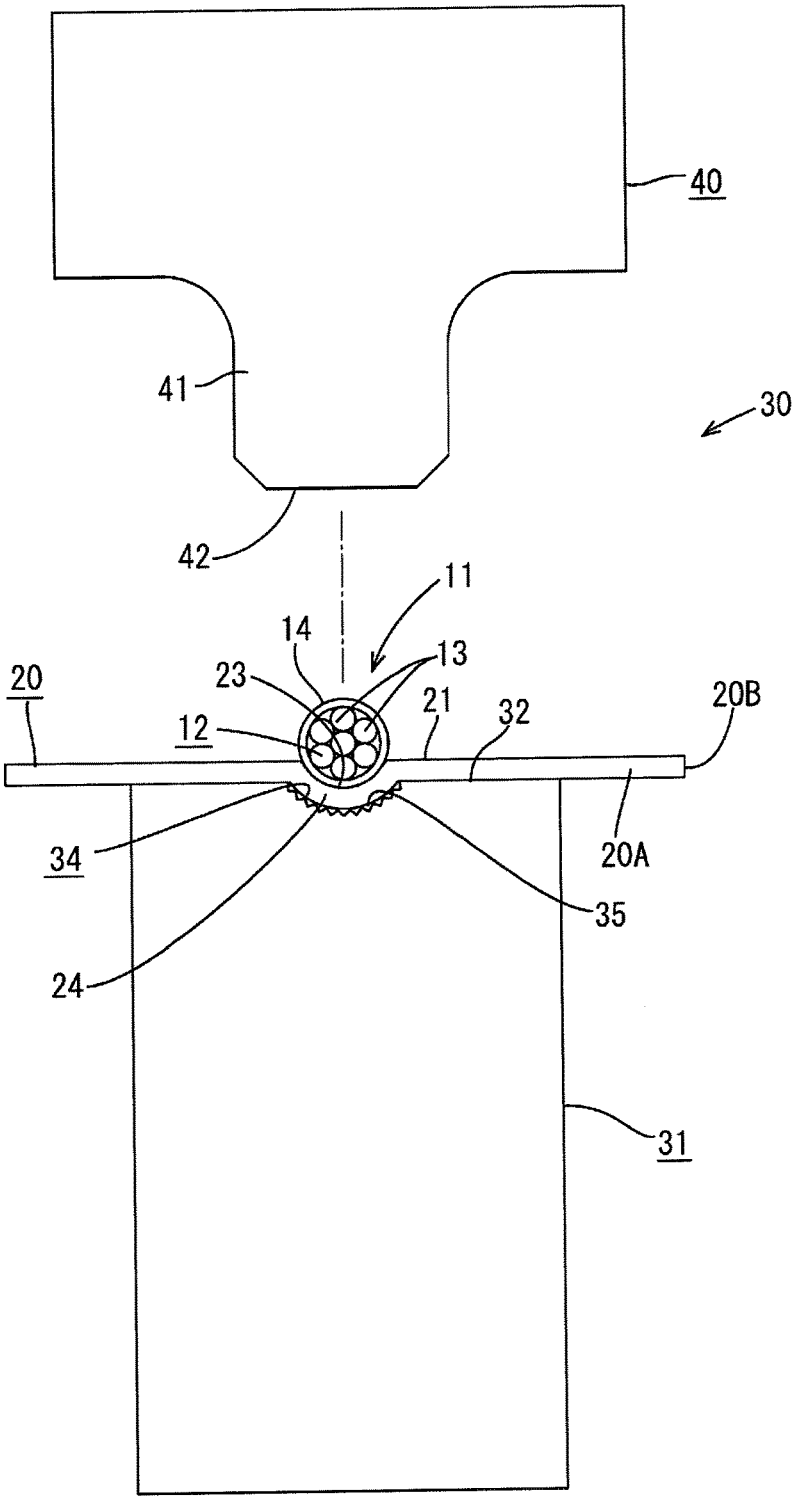
FIG. 2 is a front view of a state before ultrasonic welding is performed.
Figure 3:
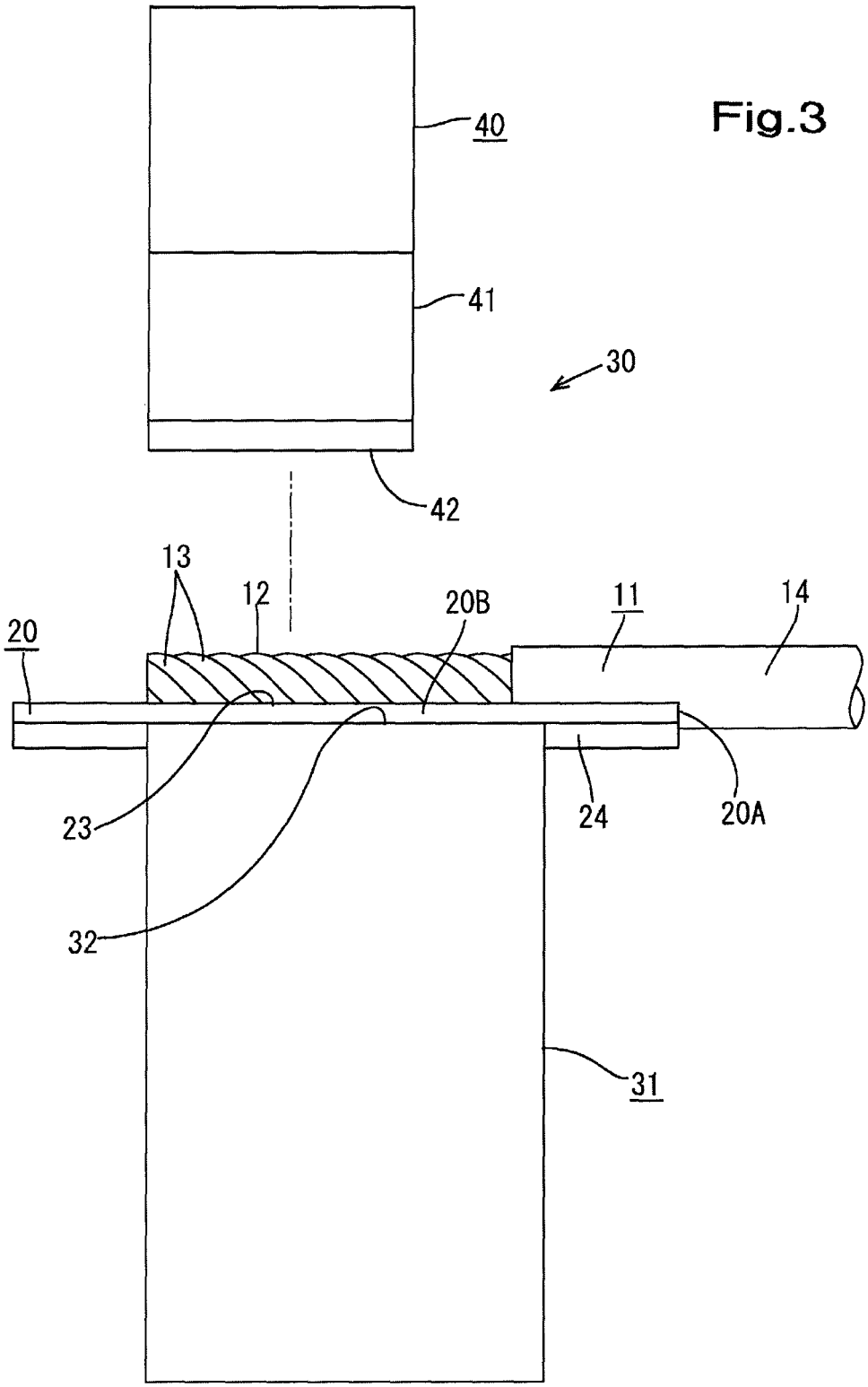
FIG. 3 is a side view of a state before ultrasonic welding is performed.

As shown in FIGS. 1 to 3, the ultrasonic welding jig 30 is constituted by including an anvil 31 and a welding horn 40 that is arranged opposing the upper portion of the anvil 31.

Figure 4:
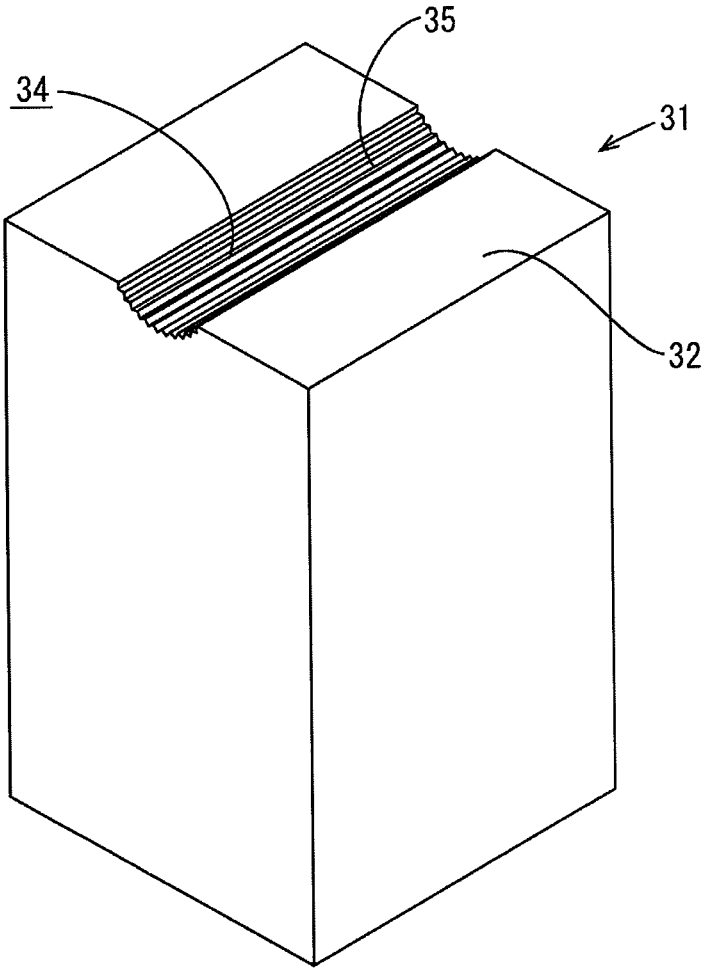
FIG. 4 is a perspective view of an anvil.
Figure 5:
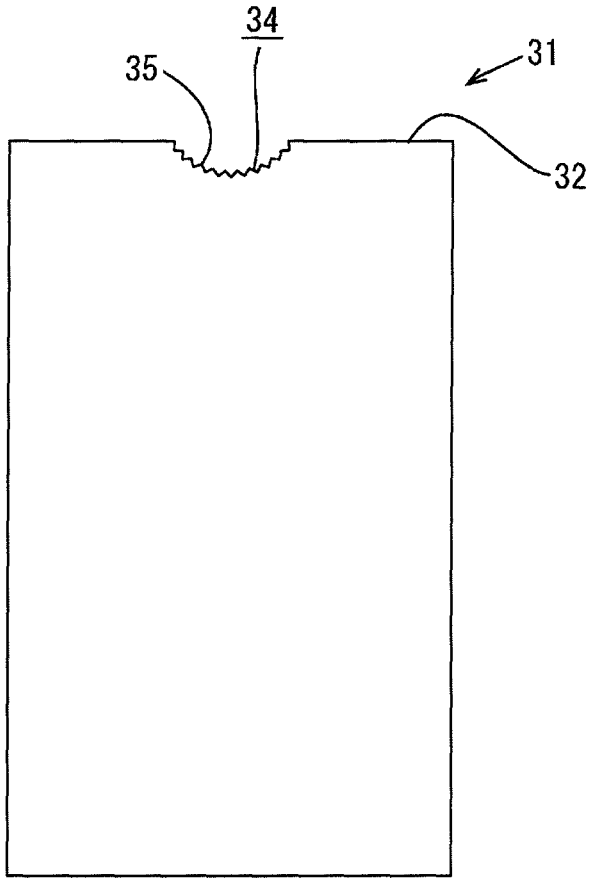
FIG. 5 is a front view of the anvil.
Figure 6:
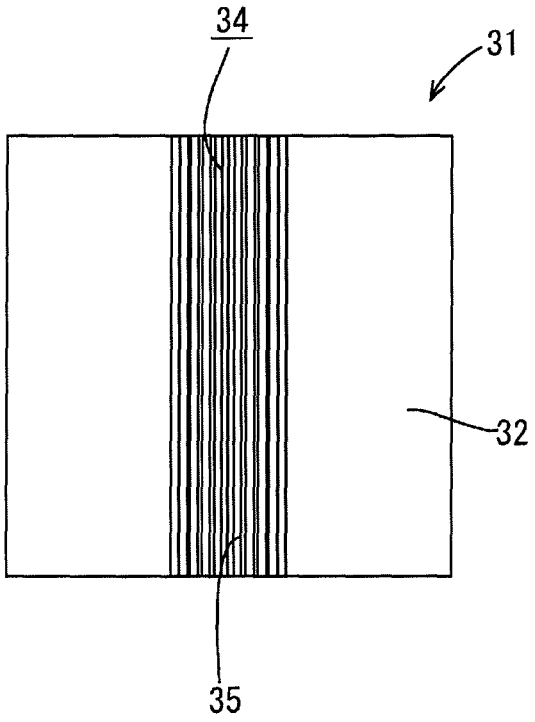
FIG. 6 is a plan view of the anvil.

The anvil 31 is provided in a fixed manner, and as shown in FIGS. 4 to 6, the upper surface thereof is provided with a placement surface 32 having a square shape that is smaller than the above-described bus bar 20. The placement surface 32 is provided with a recessed groove 34 into which the bottom wall 24 pushed out toward the lower surface side of the positioning groove 23 formed on the bus bar 20 fits tightly. A serrated slippage prevention groove 35 is formed on the bottom surface of the recessed groove 34.

As shown in FIG. 2, the welding horn 40 has a shape in which a pressing portion 41 for pressing the terminal end of the core wire 12 of the coated electrical wire 11 is formed so as to protrude on the lower surface of the welding horn 40, and a flat pressing surface 42 is formed on the lower surface of the pressing portion 41. The welding horn 40 can move in the up-down direction, which is the direction of moving toward and away from the anvil 31, due to a drive mechanism (not shown), and as indicated by the arrow line in FIG. 9, the welding horn 40 can ultrasonically vibrate in the direction along the vertical side 20B of the bus bar 20, that is, along the axis line direction of the core wire 12.

Next, an example of a procedure for manufacturing the terminal-equipped electrical wire 10 will be described.

As shown in FIGS. 1 to 3, the electrical wire connection portion 21 of the bus bar 20 is placed on the placement surface 32 of the anvil 31 in a state in which the welding horn 40 of the ultrasonic connection jig 30 is retracted to an upward position. Specifically, as shown in FIG. 2, the bottom wall 24 that bulges toward the lower surface side of the positioning groove 23 is positioned and placed by being fit into the recessed groove 34.

Next, the terminal end of the exposed core wire 12 of the coated electrical wire 11 is placed on the electrical wire connection portion 21 of the bus bar 20 that is positioned and placed on the placement surface 32 of the anvil 31. Specifically, as shown in FIGS. 2 and 3, a length portion that spans from the terminal end of the coated electrical wire 11, that is, from the exposed core wire 12, to the terminal end portion of the insulating coating 14 is fit into a region that spans from a position that is located a predetermined dimension in from the near edge (edge on the left side of FIG. 3) of the positioning groove 23 to the far edge of the positioning groove 23.

Accordingly, as shown in FIG. 3, the predetermined length portion that is at least on the leading end side of the exposed core wire 12 of the coated electrical wire 11 is placed at the proper position corresponding to directly below the pressing surface 42 of the welding horn 40 on the electrical wire connection portion 21 of the bus bar 20, in a state of being positioned by being fit into the positioning groove 23.

Figure 7:
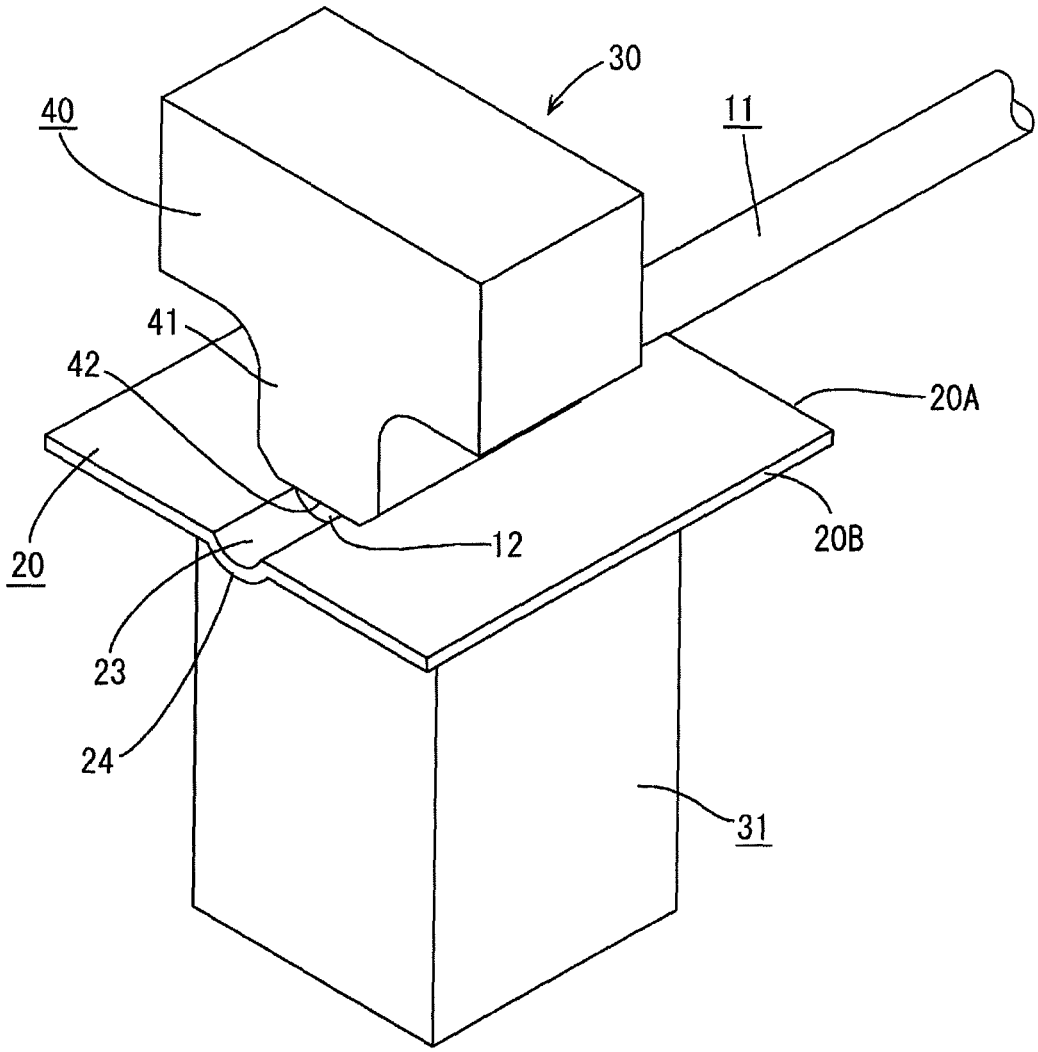
FIG. 7 is a perspective view of a state of carrying out ultrasonic welding.
Figure 8:
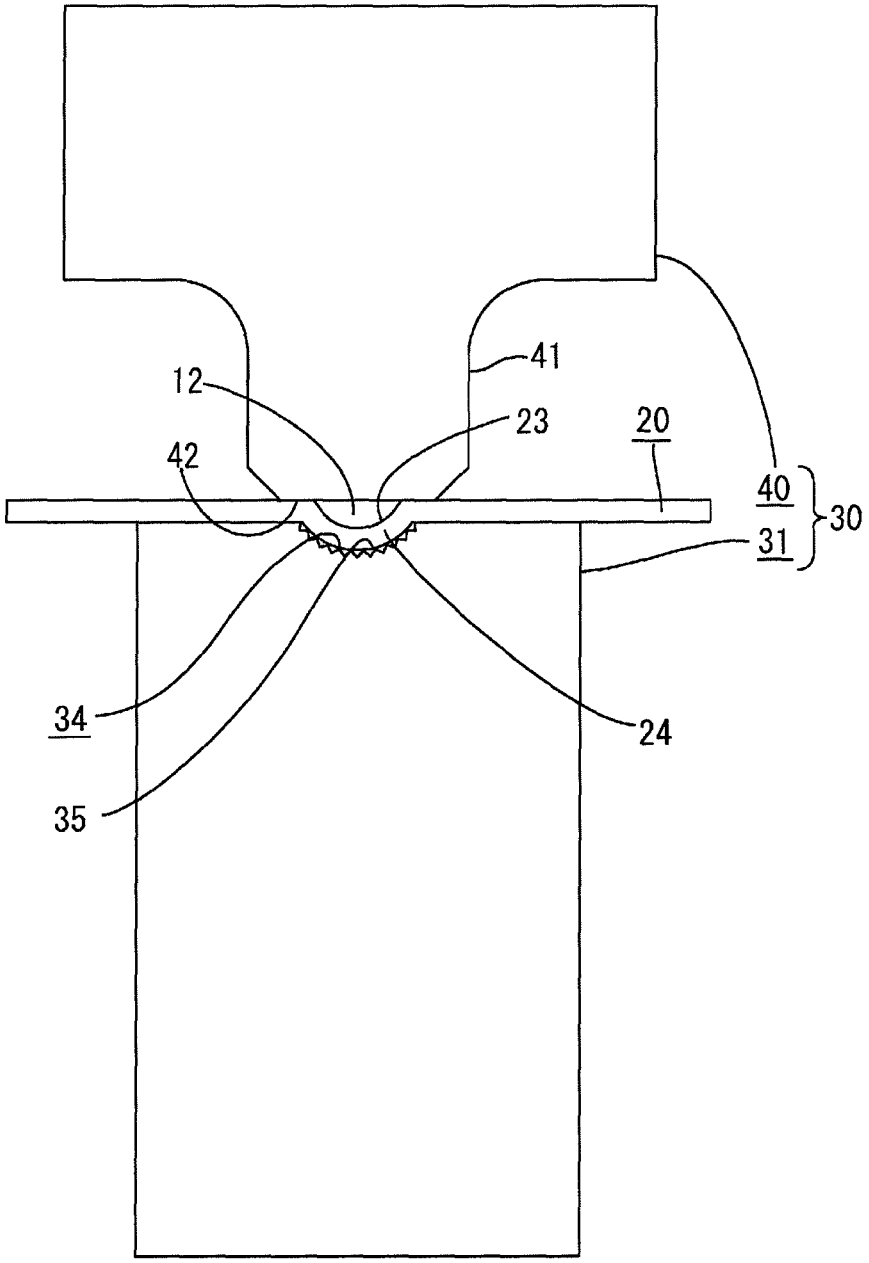
FIG. 8 is a front view of a state of carrying out ultrasonic welding.
Figure 9:
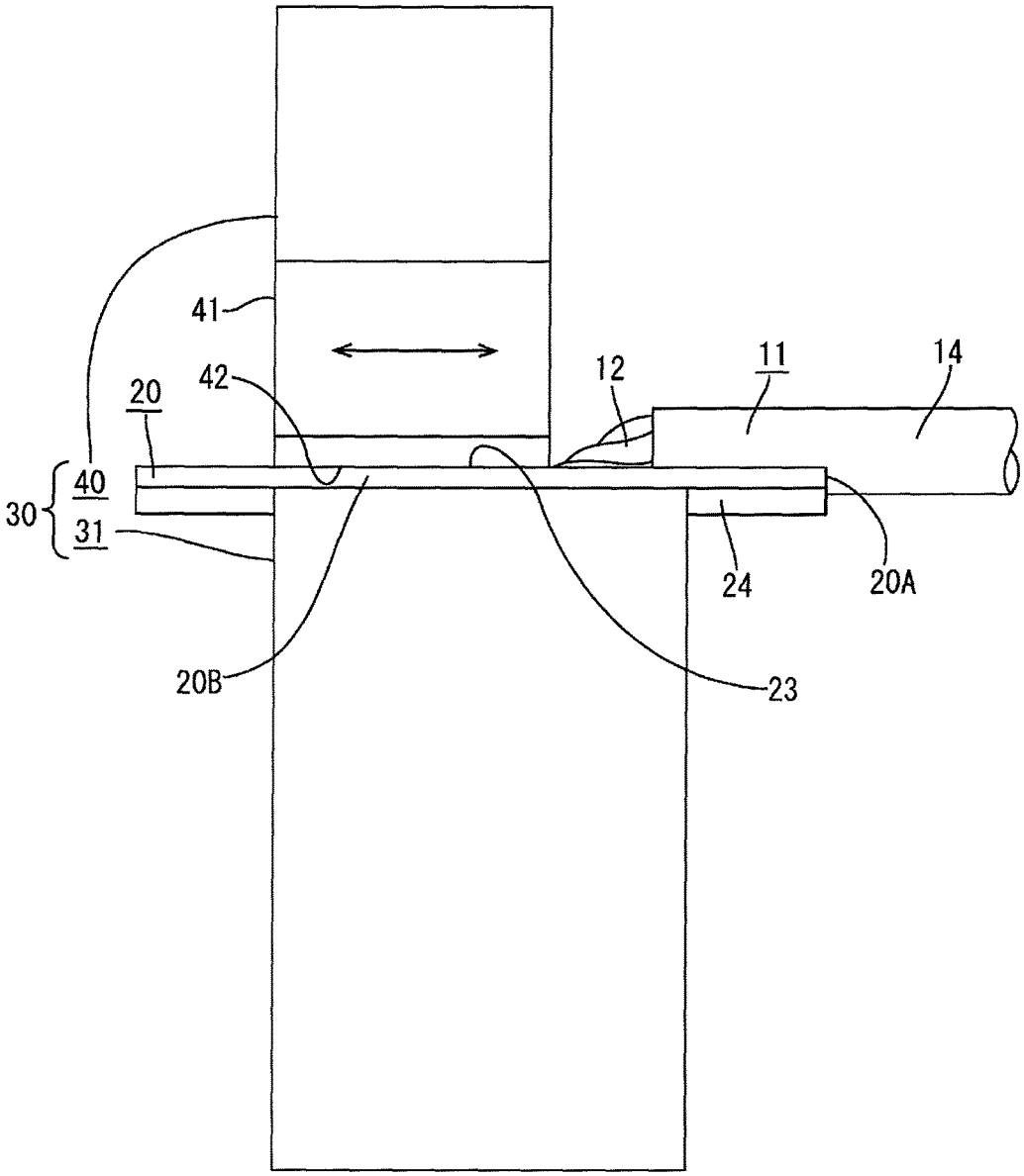
FIG. 9 is a side view of a state of carrying out ultrasonic welding.
Figure 10:
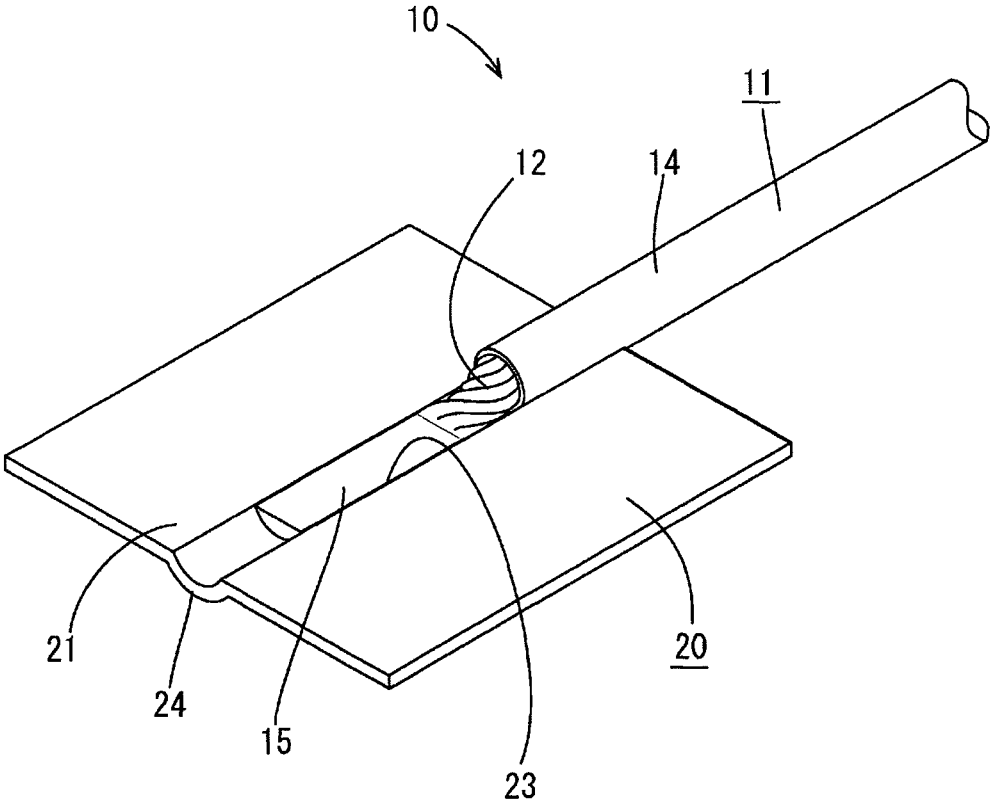
FIG. 10 is a perspective view of a terminal-equipped electrical wire.

When the bus bar 20 and the core wire 12 of the coated electrical wire 11 are set, as shown in FIGS. 7 to 9, the welding horn 40 is lowered, the pressing surface 42 presses the core wire 12 to the groove bottom of the positioning groove 23 formed in the electrical connection portion 21 of the bus bar 20, and the welding horn 40 is subjected to ultrasonic vibration in the direction indicated by the arrow line in FIG. 9. Accompanying this, the core wire 12 is ultrasonically vibrated in the axial direction while being pressed into the groove bottom of the positioning groove 23.

During this time, an oxidation film is removed at the bonding surface between the groove bottom of the positioning groove 23 formed on the electrical wire connection portion 21 of the bus bar 20 and the core wire 12 of the coated electrical wire 11, and thereafter atom dispersion is caused between the bonding surfaces and atom bonding is carried out, whereby the core wire 12 of the coated electrical wire 11 is embedded in the positioning groove 23 and is adhered to the electrical wire connection portion 21 of the bus bar 20 by being ultrasonically welded.

Figure 11:
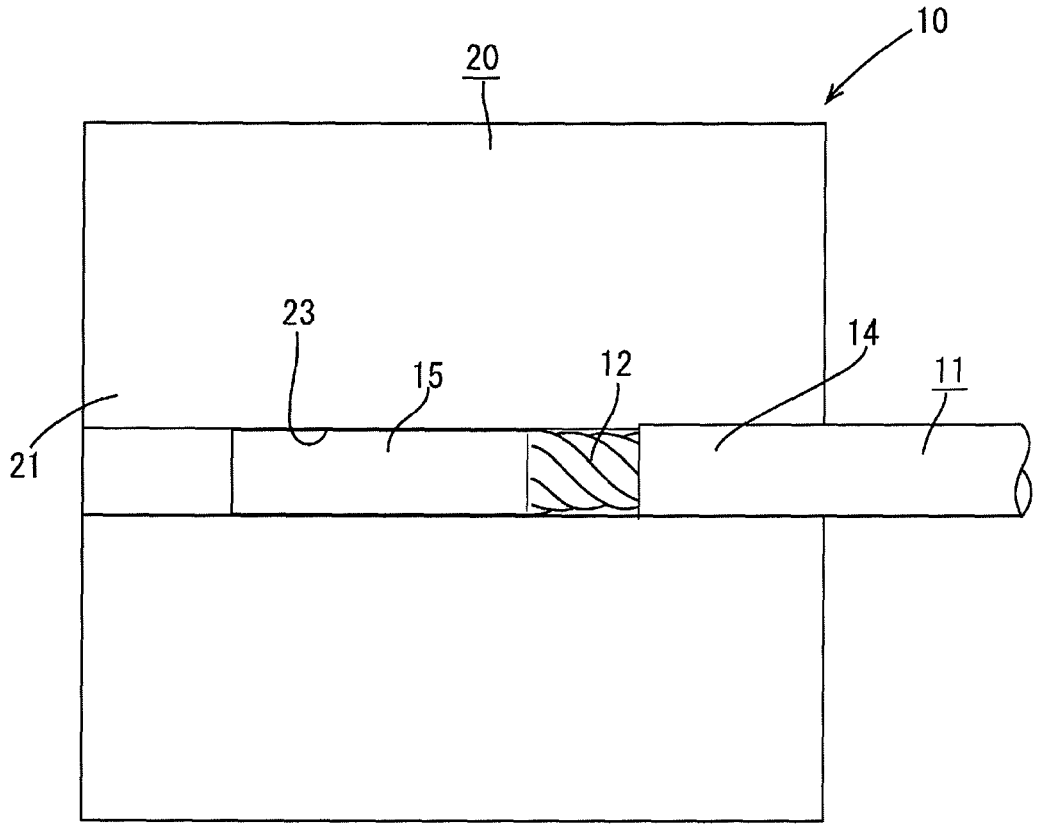
FIG. 11 is a plan view of the terminal-equipped electrical wire.
Figure 12:
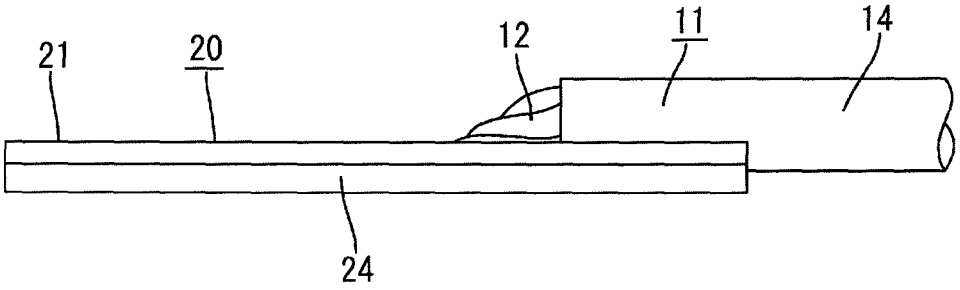
FIG. 12 is a side view of the terminal-equipped electrical wire.

When the welding step ends, the ultrasonic vibration of the welding horn 40 is stopped and the welding horn 40 is retracted upward, and thus, as shown in FIGS. 10 to 12, a terminal-equipped electrical wire 10 formed by the core wire 12 of the coated electrical wire 11 being adhered through ultrasonic welding to the electrical wire connection portion 21 of the bus bar 20 is extracted.

In the terminal-equipped electrical wire 10, a mode is employed in which a portion (welded portion 15) of the core wire 12 that is ultrasonically welded to the electrical wire connection portion 21 of the bus bar 20 has a circular arc-shaped cross section and is completely embedded in the positioning groove 23.

As described above, in the present embodiment, the positioning groove 23 into which the core wire 12 is fit is formed in advance on the upper surface of the electrical wire connection portion 21 of the bus bar 20 so as to ultrasonically weld the core wire 12 of the coated electrical wire 11. For this reason, in a prior step, when the core wire 12 of the coated electrical wire 11 is placed on the electrical wire connection portion 21 of the bus bar 20 received by the anvil 31, the core wire 12 can be easily and reliably placed at the proper position on the electrical wire connection portion 21 by merely fitting the core wire 12 into the positioning groove 23. As a result, it is possible to suitably press and ultrasonically vibrate the core wire 12 using the welding horn 40, and the ultrasonic welding can be performed properly.

As shown in FIG. 10, the manufactured terminal-equipped electrical wire 10 has a structure in which the welded portion 15 of the core wire 12 that is ultrasonically welded to the electrical wire connection portion 21 of the bus bar 20 has a circular arc-shaped cross section and is completely embedded in the positioning groove 23, and therefore it is possible to check that the core wire 12 has been properly ultrasonically welded by viewing the structure.

Also, in the present embodiment, due to the fact that the bus bar 20 is relatively thin, the positioning groove 23 provided on the electrical wire connection portion 21 is formed by pushing out the bottom wall 24 toward the lower surface side of the electrical wire connection portion 21. Because of this, the recessed groove 34 into which the bottom wall 24 of the positioning groove 23 is fit is formed on the placement surface 32 of the anvil 31. For this reason, when the bus bar 20 is placed on the placement surface 32 of the anvil 31, the bottom wall 24 pushed out to the lower surface side of the positioning groove 23 is placed while being fit into the recessed groove 34, and thus the electrical wire connection portion 21 of the bus bar 20 can be placed easily and reliably at the proper position on the anvil 31.

Embodiment 2

Figure 13:
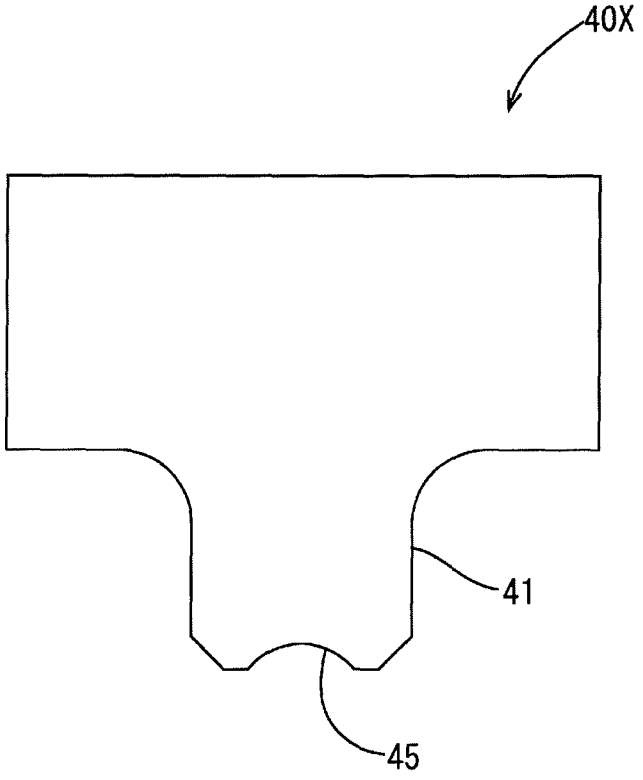
FIG. 13 is a front view of a welding horn according to Embodiment 2.

In Embodiment 2 shown in FIG. 13, a change is added to the shape of the welding horn 40X. That is, a pressing groove 45 having a circular arc-shaped cross section into which the core wire 12 (see FIG. 2) of the coated electrical wire 11 to be ultrasonically welded is fit is formed on the lower surface of the pressing portion 41 of the welding horn 40X.

In the welding step, the ceiling surface of the pressing groove 45 of the welding horn 40 is subjected to ultrasonic welding by ultrasonically vibrating the core wire 12 in the axial direction while pressing the core wire 12 to the groove bottom of the positioning groove 23 (see FIG. 2) of the electrical wire connection portion 21 of the bus bar 20.

Since the core wire 12 is more reliably positioned when interposed between the positioning groove 23 and the pressing groove 45, ultrasonic welding is more suitably performed.

Embodiment 3

Figure 14:
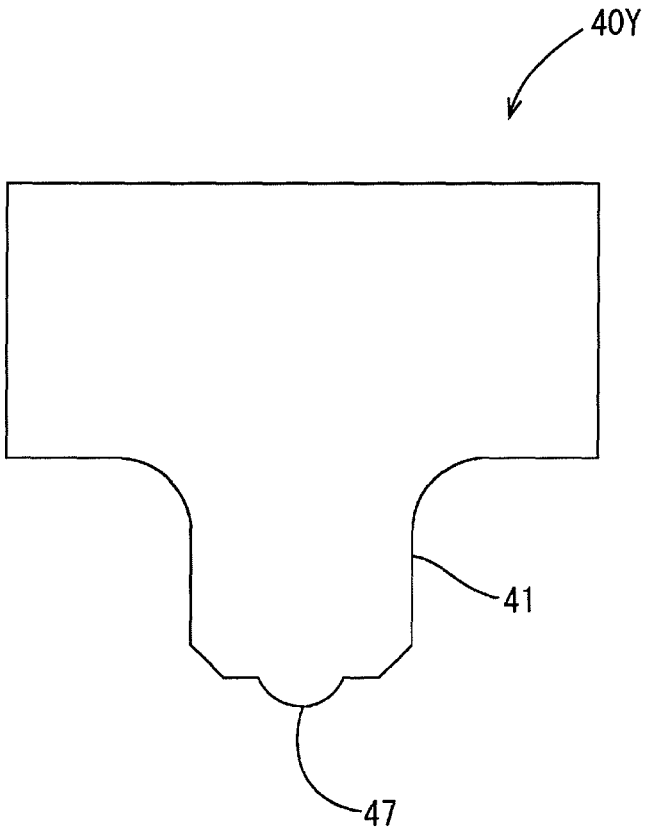
FIG. 14 is a front view of the welding horn according to Embodiment 3.

In Embodiment 3, another change is added to the shape of the welding horn 40Y. That is, as shown in FIG. 14, a shape may be used in which a pressing projection 47 having a circular arc-shaped cross section is formed on the lower surface of the pressing portion 41 of the welding horn 40Y.

Embodiment 4

Figure 15:
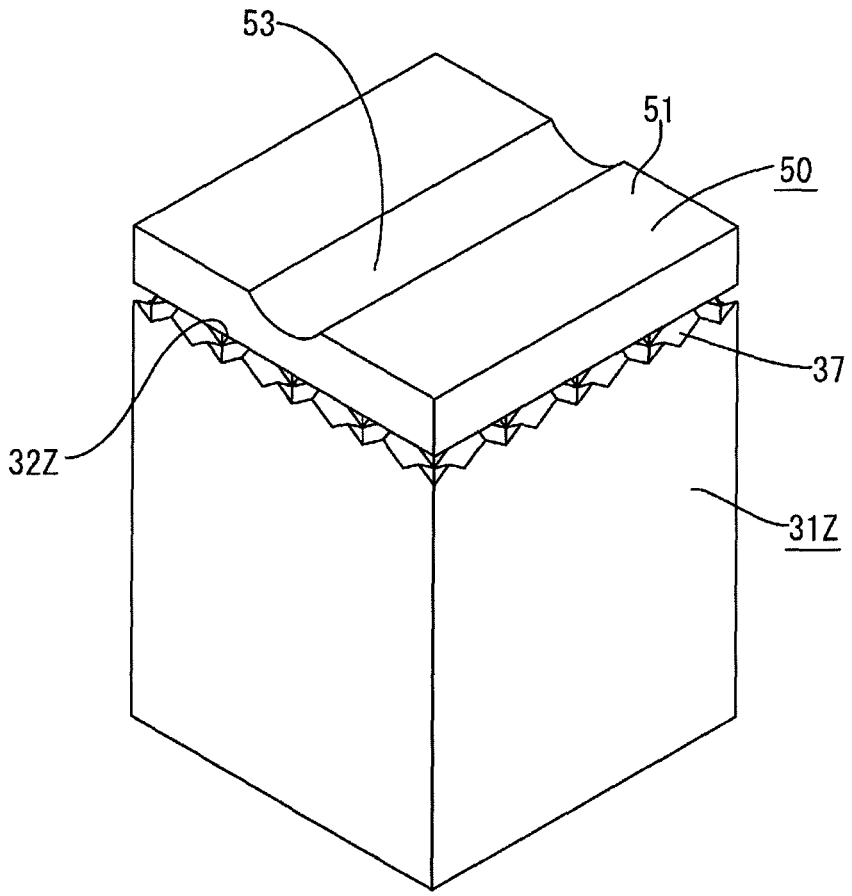
FIG. 15 is a perspective view of a state in which a bus bar is mounted on the anvil according to Embodiment 4.

Embodiment 4 will be described with reference to FIGS. 15 to 16. In Embodiment 4, a comparatively thin bus bar 50 is given as an example of a "terminal" to which the core wire 12 of the coated electrical wire 11 is connected through ultrasonic welding.

With this bus bar 50, the positioning groove 53 into which the terminal of the exposed core wire 12 of the coated electrical wire 11 is fit is formed recessed through crushing or the like on the electrical wire connection portion 51 set in the central portion.

Figure 16:
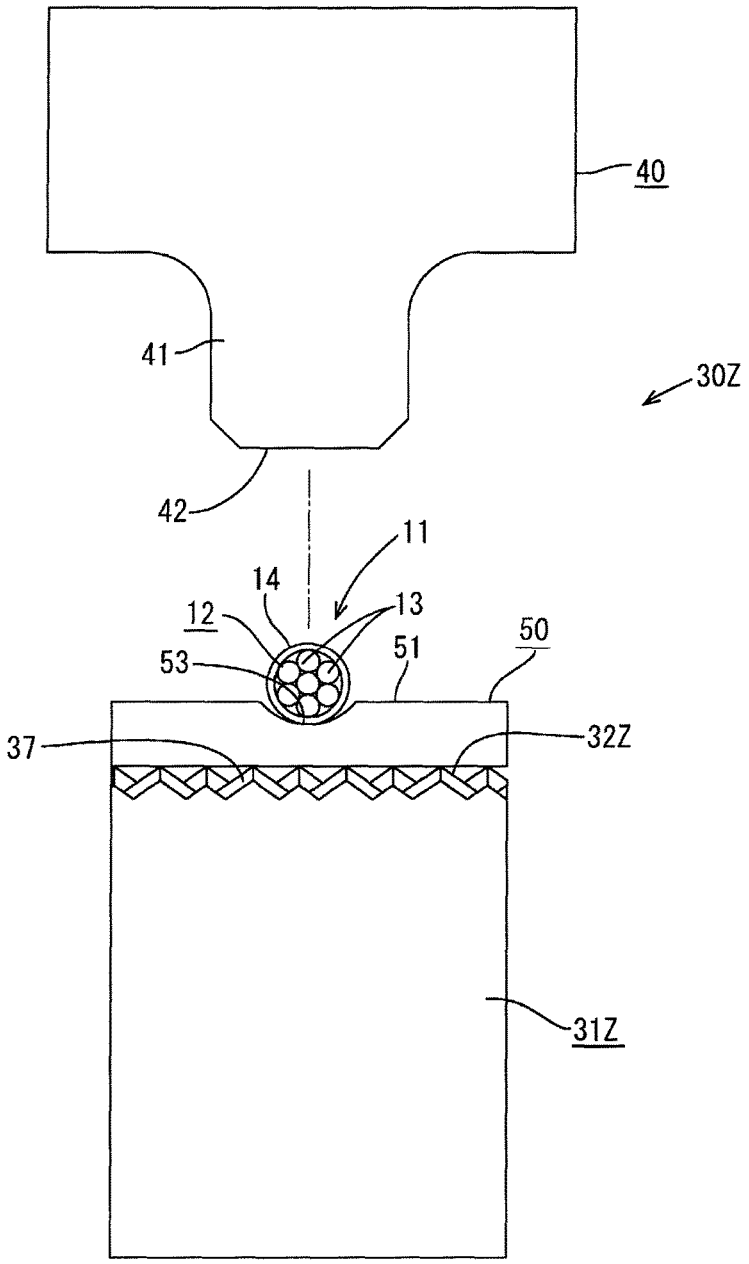
FIG. 16 is a front view of a state before ultrasonic welding is performed.

As shown in FIG. 16, an ultrasonic welding jig 30Z is constituted by including an anvil 31Z and a welding horn 40 that is arranged opposing the upper portion thereof. Knurls 37 are formed so as to prevent slippage on the placement surface 32Z set on the upper surface of the anvil 31Z. The welding horn 40 has a shape including a flat pressing surface 42, similarly to Embodiment 1.

The effect is similar to that of Embodiment 1 above, and to simply reiterate, the electrical wire connection portion 51 of the bus bar 50 is placed on the placement surface 32Z of the anvil 31Z, and thereafter, as shown in FIG. 16, the terminal end of the exposed core wire 12 of the coated electrical wire 11 is positioned by being fit into the positioning groove 53 and is placed on the electrical wire connection portion 51.

Next, the welding horn 40 is lowered, the pressing surface 42 presses the core wire 12 to the groove bottom of the positioning groove 53 formed on the electrical connection portion 51, and the welding horn 40 is ultrasonically vibrated, that is, the welding horn 40 is ultrasonically vibrated in the axial direction while the core wire 12 is pressed to the groove bottom of the positioning groove 53.

As a result, the core wire 12 of the coated electrical wire 11 is ultrasonically welded and adhered to the electrical wire connection portion 51 of the bus bar 50 while embedded in the positioning groove 53.

In Embodiment 4 as well, similarly, it is possible to properly press and ultrasonically vibrate the core wire 12 of the coated electrical wire 11 using the welding horn 40, and the ultrasonic welding can be performed properly. In particular, Embodiment 4 is conveniently applied in the case where the bus bar 50 (electrical wire connection portion 51) is comparatively thin.

Other Embodiments

The technique disclosed in the present embodiment is not limited to the embodiments described with reference to the above description and the drawings, and for example, the following embodiments are also included.

(1) The terminal is not limited to the bus bar illustrated in the above-described embodiments, and may be a terminal with a structure in which a flat plate-shaped electrical wire connection portion is provided rearward of the terminal connection portion connected to a partner terminal or the like.

(2) In the above-described embodiments, a case was illustrated in which an exposed core wire is ultrasonically welded to a terminal end of a coated electrical wire, but the present invention can similarly be applied also to the case where an exposed core wire is ultrasonically welded to an intermediate position in the length direction of the coated electrical wire.

(3) The electrical wire also encompasses a bare twisted wire that does not include an insulating coating.

(4) The core wire of the electrical wire is not limited to a twisted wire and may be a single core wire or a straight wire obtained by bundling multiple straight metal strands.

(5) The welding horn illustrated in Embodiment 2 or Embodiment 3 may be applied to the welding horn in Embodiment 4 as well.

REFERENCE SIGNS LIST

10 Terminal-equipped electrical wire
11 Coated electrical wire (electrical wire)
12 Core wire
15 Welded portion
20 Bus bar (terminal)
21 Electrical wire connection portion
23 Positioning groove
24 Bottom wall
30, 30Z Ultrasonic welding jig
31, 31Z Anvil
32, 32Z Placement surface
34 Recessed groove
40, 40X, 40Y Welding horn
50 Bus bar (terminal)
51 Electrical wire connection portion
53 Positioning groove

The invention claimed is:

1. A method for manufacturing a terminal-equipped electrical wire including a core wire, the core wire of the electrical wire being connected to a flat plate-shaped electrical wire connection portion provided on a terminal, wherein an ultrasonic welding jig including an anvil and a welding horn is provided, the core wire of the electrical wire is placed on the electrical wire connection portion after the electrical wire connection portion of the terminal is placed on the anvil, and the core wire is ultrasonically welded to the electrical wire connection portion by applying ultrasonic vibration along an axial direction of the core wire while pressing the core wire with the welding horn, a positioning groove into which the core wire of the electrical wire is to be fit being formed in advance on an upper surface of the electrical wire connection portion of the terminal, and the core wire being placed on the electrical wire connection portion while being fit into the positioning groove, wherein the positioning groove is formed with a bottom wall of the positioning groove pushed out toward the lower surface side of the electrical wire connection portion, a recessed groove into which the bottom wall of the positioning groove is to fit is formed on an upper surface of the anvil, and the electrical wire connection portion is placed on the anvil while the bottom wall of the positioning groove is fit into the recessed groove.

2. A terminal-equipped electrical wire including a core wire, the core wire of the electrical wire being ultrasonically welded to a flat plate-shaped electrical wire connection portion provided on a terminal, wherein a positioning groove is formed on an upper surface of the electrical wire connection portion and a welded portion of the core wire is welded adhered while fit into the positioning groove, wherein the positioning groove is formed with a bottom wall of the positioning groove pushed out toward the lower surface side of the electrical wire connection portion, a recessed groove into which the bottom wall of the positioning groove is to fit is formed on an upper surface of the anvil, and the electrical wire connection portion is placed on the anvil while the bottom wall of the positioning groove is fit into the recessed groove.

3. The terminal-equipped electrical wire according to claim 2, wherein the positioning groove is formed with an upper surface of the electrical wire connection portion recessed.

* * * * *